US006709312B2

(12) United States Patent
Mautz

(10) Patent No.: US 6,709,312 B2
(45) Date of Patent: Mar. 23, 2004

(54) METHOD AND APPARATUS FOR MONITORING A POLISHING CONDITION OF A SURFACE OF A WAFER IN A POLISHING PROCESS

(75) Inventor: Karl E. Mautz, Round Rock, TX (US)

(73) Assignee: Motorola, Inc., Schaumburg, IL (US)

( * ) Notice: Subject to any disclaimer, the term of this patent is extended or adjusted under 35 U.S.C. 154(b) by 0 days.

(21) Appl. No.: 10/180,740

(22) Filed: Jun. 26, 2002

(65) Prior Publication Data

US 2004/0002289 A1 Jan. 1, 2004

(51) Int. Cl.[7] ..... B24B 47/00

(52) U.S. Cl. ..... 451/5; 451/10; 451/41; 451/6

(58) Field of Search ..... 451/5–10, 41, 451/28

(56) References Cited

U.S. PATENT DOCUMENTS

| | | | | |
|---|---|---|---|---|
| 5,461,007 A | | 10/1995 | Kobayashi | |
| 5,609,511 A | * | 3/1997 | Moriyama et al. | 451/5 |
| 6,102,775 A | | 8/2000 | Ushio | |
| 6,142,855 A | | 11/2000 | Nyui | |
| 6,224,460 B1 | * | 5/2001 | Dunton et al. | 451/6 |
| 6,280,289 B1 | * | 8/2001 | Wiswesser et al. | 451/6 |
| 6,489,624 B1 | * | 12/2002 | Ushio et al. | 250/559.27 |
| 2001/0009838 A1 | | 7/2001 | Dunton | |

FOREIGN PATENT DOCUMENTS

| | | |
|---|---|---|
| EP | 1055903 A1 | 11/2000 |
| JP | 2000033561 | 2/2000 |
| WO | WO 99/23449 | 5/1999 |
| WO | WO 99/64205 | 12/1999 |

OTHER PUBLICATIONS

U.S. patent application Ser. No. 09/652, 898.

* cited by examiner

*Primary Examiner*—Lee D. Wilson
(74) *Attorney, Agent, or Firm*—Kim-Marie Vo; Patricia S. Goddard

(57) ABSTRACT

A method for monitoring a polishing condition of a surface of a wafer in a polishing process is provided, the method comprising providing a wafer (16) to be polished, the wafer (16) having at least one optically distinguishable feature (20) below a transparent or translucent layer (22) to be polished; selecting one or more of the features (20) for monitoring; measuring an optical contrast profile (62; 72; 82; 92) across one or more of the selected features (20); determining the polishing condition of the surface of the wafer (16) on the basis of the measured contrast profile (62; 72; 82; 92); and repeating the measuring the optical contrast profile (62; 72; 82; 92) and determining the polishing condition until a predetermined polishing condition is reached. A method for polishing wafers by a CMP polishing tool and apparatus for monitoring a polishing condition of a surface of a wafer (16) is also provided.

13 Claims, 2 Drawing Sheets

METHOD AND APPARATUS FOR MONITORING A POLISHING CONDITION OF A SURFACE OF A WAFER IN A POLISHING PROCESS

FIELD OF THE INVENTION

The present invention generally relates to a method and apparatus for monitoring a polishing condition of a surface of a wafer in a polishing process. The present invention is particularly useful for determining an end-point in a chemical mechanical polishing (CMP) process.

BACKGROUND OF THE INVENTION

Chemical mechanical polishing (also referred to as chemical mechanical planarization) or CMP is a proven process in the manufacture of advanced integrated circuits. CMP is used in almost all stages of semiconductor device fabrication. Chemical mechanical planarization allows the creation of finer structures via local planarization and for global wafer planarization to produce high density structures.

During a CMP process, a substrate is mounted to a carrier or polishing head. The exposed surface of the substrate is moved against a rotating polishing pad on a polishing platen. A polishing slurry is distributed over the polishing pad. The slurry includes an abrasive and at least one chemically reactive agent. The abrasive chemical solution is provided at the interface between the polishing pad and the wafer in order to facilitate the polishing.

It is generally desirable to control the CMP process to find an endpoint for polishing or to determine the thickness of a polished layer.

One prior art attempt to control the CMP process uses pre and/or post measurements of wafers with either manual or automatic processing. Systems are available which allow measurement of the wafers immediately before and after polishing. If the film thickness before and after polishing is known, it is possible to adjust the polishing parameters and to optimize the polishing process within a production sequence. However, such a pre and/or post measurement method has the disadvantage that at least the first wafer or the first few wafers have to be polished with the default parameter settings, i.e. without optimized parameters. Typically, these first wafers are targeted to underpolish, such that subsequent repolishing can be done to achieve the specification range.

Several methods have been suggested to obtain a reliable endpoint for the polishing process. Current methods include measuring temperature, shaft friction, vibration, sonic level, or frequency. Unfortunately, these methods do not work for all substrates, particularly when an oxide is polished. A large number of CMP processes use timed polishing steps for specific films or wafers. These processes generally lead to a relatively wide range of results, as the variation of factors such as polish head condition, slurry refreshing, down force, or pressure cause the polishing rate to change during the processing of a large batch of wafers.

Since overpolishing of wafers is catastrophic and severe overpolish may result in destroyed wafers, wafers are typically targeted to underpolish, since an under-polish condition may be removed by reprocessing the wafers to bring them up to specification. However targeting for an underpolish often leads to a significant number of wafers that require repolishing, thereby lowering the throughput and increasing the overall processing costs. Further, the time for which the underpolished wafers need to be repolished is usually calculated manually, taking the removed film thickness, the target thickness and the wafer polish time into account. Repolishing thus requires significant human resources.

While for larger device dimensions the process target specifications tend to be rather relaxed, there are increasing requirements to tighten the film removal range as device technologies shrink.

In view of the above, the present invention seeks to solve the above mentioned problems and shortcomings of the prior art and intends to provide a method and an apparatus which allows for an improved determination of the endpoint in a polishing process.

It would further be advantageous to have a method for polishing wafers with increased throughput, improved process uniformity and reduced processing costs.

BRIEF DESCRIPTION OF THE DRAWINGS

FIG. 3(*b*) shows an illustration of an optical contrast profile across the field of view of FIG. 3(*a*) as output by the optical sensor;

DETAILED DESCRIPTION OF A PREFERRED EMBODIMENT

Figure 1:
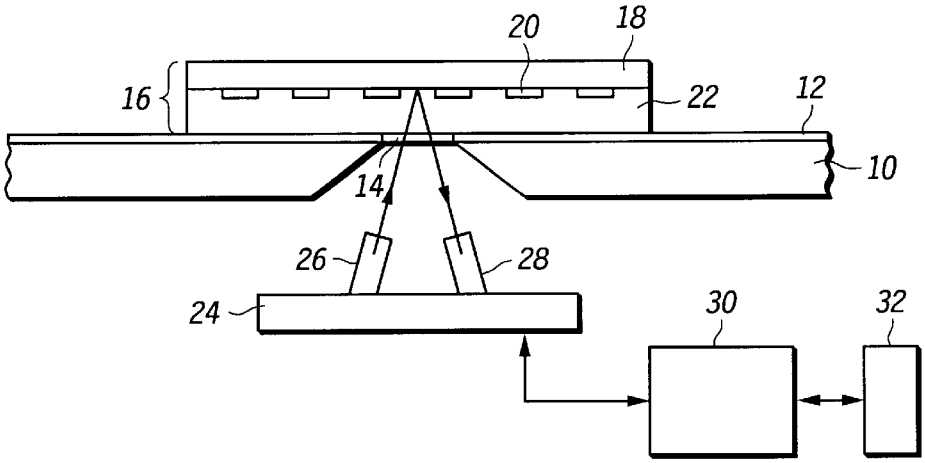
FIG. 1 is a partial schematic illustration of a chemical mechanical polishing apparatus according to an embodiment of the present invention.

According to the present invention, a method for monitoring a polishing condition of a surface of a wafer in a polishing process is provided, the method comprising the steps of: providing a wafer 16 to be polished, the wafer 16 having at least one optically distinguishable feature 20 below a transparent or translucent layer 22 to be polished; selecting one or more of said features 20 for monitoring; measuring an optical contrast profile 62; 72; 82; 92 (FIGS. 3–6) across one or more of said selected features 20; determining the polishing condition of the surface of the wafer 16 on the basis of the measured contrast profile 62; 72; 82; 92; and repeating the steps of measuring the optical contrast profile 62; 72; 82; 92 and determining the polishing condition until a predetermined polishing condition is reached.

According to another aspect of the present invention, a method for polishing wafers by a chemical mechanical polishing tool is provided, the method comprising the steps of setting polishing parameters of a chemical mechanical polishing tool; polishing at least one wafer 16 and monitoring a polishing condition of a surface of the wafer 16 by providing the wafer 16 to the polishing tool, the wafer having at least one optically distinguishable feature 20 below a transparent or translucent layer 22 to be polished, selecting one or more of said features 20 for monitoring, measuring an optical contrast profile 62; 72; 82; 92 across one or more of said selected features 20, determining the polishing condition of the surface of the wafer 16 on the basis of the measured contrast profile 62; 72; 82; 92; and repeating the steps of measuring the optical contrast profile 62; 72; 82; 92 and determining the polishing condition until a predetermined polishing condition is reached, and adjusting the polishing parameters of said polishing tool on the basis of the results of monitoring the polishing condition to improve process throughput and process uniformity.

According to a further aspect of the present invention, there is provided an apparatus for monitoring a polishing condition of a surface of a wafer 16 having at least one optically distinguishable feature 20 below a transparent or translucent layer 22 to be polished, the apparatus comprising:

means for providing a wafer 16 to be polished;

means for selecting one or more of said features 20 for monitoring;

means 24, 26, 28 for measuring an optical contrast profile 62; 72; 82; 92 across one or more of said selected features 20;

means 30 for determining the polishing condition of the surface on the basis of the measured contrast profile 62; 72; 82; 92; and means 30, 32 for determining whether a predetermined polishing condition is reached.

These and other features and advantages will be more clearly understood from the following detailed description taken in conjunction with the accompanying drawings.

With respect to FIG. 1, which shows a partial schematic illustration of a chemical mechanical polishing apparatus according to an embodiment of the present invention, a polishing platen 10 carries a polishing pad 12. A window 14 is provided in the polishing platen 10 and the polishing pad 12, which allows optical access to wafers located on the polishing pad 12. Arranged underneath the window 14 is an x-y stage 24, which carries a light source 26, such as a light emitting diode (LED) and an optical sensor 28.

When carrying out a CMP process, a wafer 16 is placed on the polishing pad 12, a slurry is added, and one or both of the wafer 16 and the polishing platen 10 are rotated.

From previous processing steps in the integrated circuit manufacturing process, the wafer 16 may have a complicated topography built on the original silicon substrate 18. In the context of the present invention, however, it is only relevant that the wafer has at least one optically distinguishable feature 20 with at least one sharp edge below the transparent or translucent layer 22 that needs to be polished. The feature 20 could be a device feature from within the die, or a feature in a test area such as the scribe grid. Layer 22 may, for example, be an oxide layer.

FIG. 1 also shows a control unit 30 and a control unit memory 32 whose function will become clear from the detailed explanation below. In the following, the method for monitoring a polishing condition of a surface of a wafer in a polishing process is described with reference to FIG. 2, and particularly to FIGS. 3 to 6, which show schematic illustration of the illuminated field of view of the wafer 16 and optical contrast profiles obtained from the optical sensor 28 at various stages of the CMP process.

Figure 2:
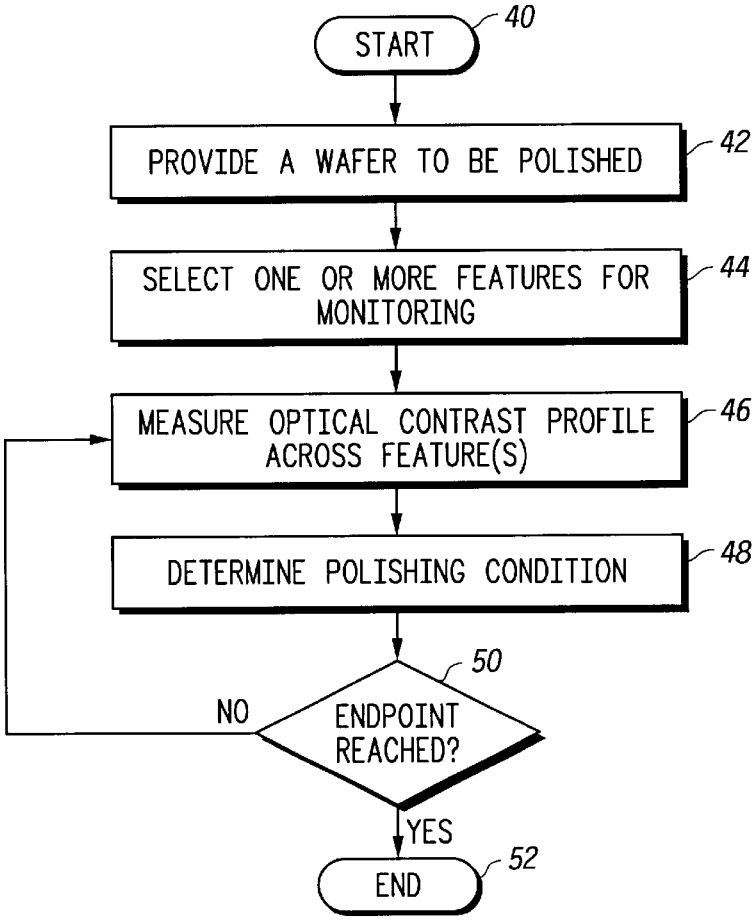
FIG. 2 is a process flow diagram illustrating an embodiment of a method according to the invention.

Starting at reference sign 40 in the process flow diagram of FIG. 2, a wafer 16 is provided to a CMP tool in step 42. It is properly oriented and loaded on a polishing head such that one or more of the relevant features 20 are accessible to the light source 26. Next, in step 44, one or more of the features 20 are selected for monitoring. As mentioned, feature 20 may be a device feature from within the die, or a feature in a test area. It is not necessary that the same feature 20 is monitored throughout repeated measurements. If a plurality of identical or similar features 20 exist on the wafer 16, it may be sufficient to measure a different subset of features 20 in each measuring step. For example, devices such as DRAMs with their regularly repeating structures work well with such a scheme. If only one or a few features 20 are available on the wafer 16, the x-y stage 24 will generally have to be adjusted to bring the light source 26 and the sensor 28 in a suitable position.

Figure 3A:
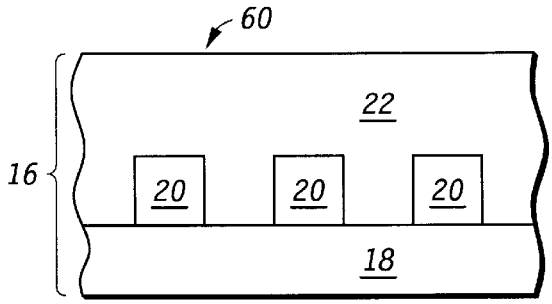
FIG. 3(*a*) shows a schematic illustration of an illuminated field of view of a wafer to be polished before the start of a CMP process.
Figure 3B:
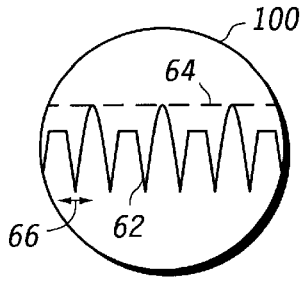

The method then proceeds to step 46, in which an optical contrast profile of the selected features 20 is measured. Sensor 28, which may be of the kind typically used in lithography to detect alignment features, measures the contrast profile across a certain field of view, as illustrated in FIG. 3. In this figure, (*a*) shows across an exemplary field of view containing three identical features 20, covered by an oxide layer 22 to be polished. Prior to the polishing process the oxide layer 22 extends up to a height level 60.

FIG. 3(*b*) shows the optical contrast profile 62 obtained from the optical sensor 28 in this situation. Attention is directed particularly to the intensity level 64 at the top surface of the features 20, which is relatively low, and the width or sharpness 66 at the dark edges of the features 20. As the oxide layer 22 covering the features 20 is still rather thick, the width appears relatively large, corresponding to a low sharpness level. The control unit 30 obtains the intensity level 64 and the sharpness 66 from the optical contrast profile 62 and determines the polishing condition of the wafer surface based on these values in step 48.

Proceeding to step 50, the control unit 30 compares the determined intensity 64 and sharpness 66 to predetermined endpoint values, stored in a control unit memory 32. If, as in the situation of FIG. 3, the result of the comparison indicates, that the endpoint for polishing has not been reached, the method returns to step 46, where, after a predetermined polishing time has lapsed, another measurement of the optical contrast profile is carried out.

Figure 4A:
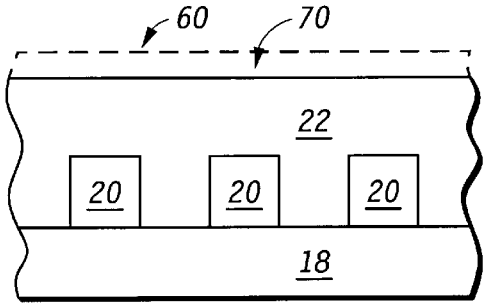
FIGS. 4(*a*) and (*b*) show illustrations as in FIGS. 3(*a*) and (*b*) in a situation where the CMP process has advanced.
Figure 4B:
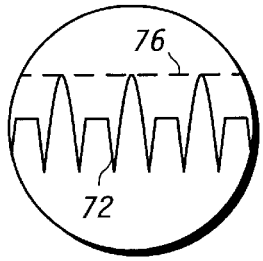

As the polishing process continues, an increasing part of the layer 22 is being removed. FIG. 4(*a*) illustrates the situation after a certain polishing time showing a reduced height level 70. As the oxide layer 22 becomes thinner, the intensity level 74 of the optical contrast profile 72 at the top surface of the features 20 increases. At the same time, the edge sharpness increases, i.e. the transitions at the edges become less wide and deepen in contrast (FIG. 4(*b*)).

Figure 5A:
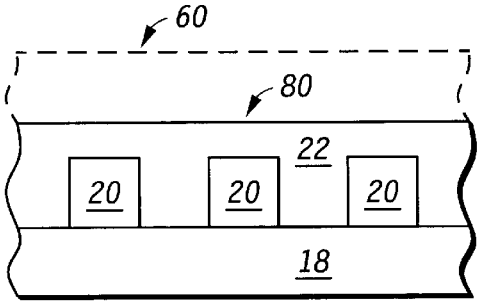
FIGS. 5(*a*) and (*b*) show illustrations as in FIGS. 3(*a*) and (*b*) at the desired endpoint of the CMP process.
Figure 5B:
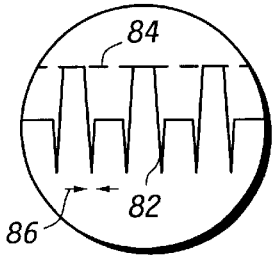

FIGS. 5(*a*) and (*b*) illustrate a situation corresponding to the desired endpoint of the polishing process, in which a layer 22 of certain thickness (height level 80) remains. Comparing the intensity 84 and the sharpness 86 of the optical contrast profile 82 at this to the predetermined values, the control unit 30 concludes that the endpoint has been reached and the method terminates at 52.

The comparison of the determined intensity and sharpness values to the stored values may, for example, be carried out by adding the weighted difference between the stored and the determined intensity value, and the weighted difference between the stored and the determined width. Appropriate weight factors can be found experimentally. If the result of this calculation is zero or negative, the desired endpoint has been reached. Otherwise, the magnitude of the positive result indicates, how much the current polishing condition deviates from the desired polishing condition.

Figure 6A:
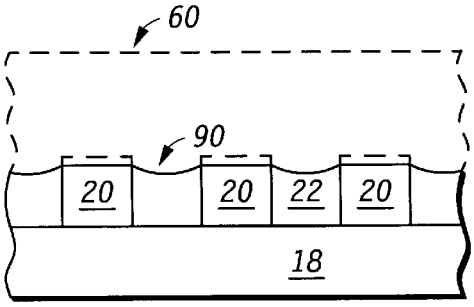
FIGS. 6(*a*) and (*b*) show illustrations as in FIGS. 3(*a*) and (*b*) in a situation where the CMP process has missed the endpoint and the wafer is damaged.
Figure 6B:
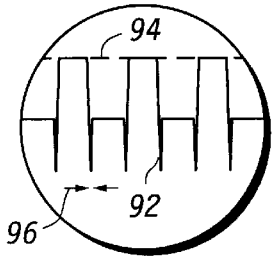

For the sake of illustration, FIG. 6 shows a situation, in which the endpoint of the polishing process has been missed and the wafer features 20 have been damaged. FIG. 6(*a*) shows the height level 90 of the oxide layer 22 to be in part even lower than the top surface of the features 20, which have themselves been partly removed. The corresponding optical contrast profile 92 shows an intensity level 94 and a sharpness 96 well beyond the predetermined endpoint values. The skilled person will appreciate that there is a sufficient margin around the exact endpoint of FIG. 5, in which the method can determine that the process endpoint has reached to prevent overpolishing to an extent that damages the wafer 16.

Further, a correlation chart can be produced to continually calculate the rate at which the film is being removed in the current polishing period, and track the total film removal for the process. This can also be to estimate the additional time needed before the expected endpoint at the current polishing rate.

An analysis of this kind of data during processing of a batch of wafers may be used to provide information on the film removal rate variation from wafer to wafer. Also, a feedback loop may be advantageously established to make adjustments to the CMP equipment hardware settings to adjust the polish rate to maximize throughput, provide improved process uniformity, and reduce processing costs. The feedback loop can further monitor the effect of equipment factors on polish rate and provide information relating to equipment performance and slurry effectiveness. It may, for example, show that part of the equipment requires maintenance or detect a change in the composition of the slurry at a batch change. Additionally, statistical process control can be done using this kind of data, especially for the same film type and polish process, to provide equipment control and improve the overall wafer processing performance.

While the invention has been described in terms of particular structures, devices and methods, those of skill in the art will understand based on the description herein that it is not limited merely to such examples and that the full scope of the invention is properly determined by the claims that follow.

What is claimed is:

1. A method for monitoring a polishing condition of a surface of a wafer in a polishing process, the method comprising the steps of providing a wafer to be polished, the wafer having at least one optically distinguishable feature below a transparent or translucent layer to be polished;

selecting one or more of said features for monitoring;

measuring an optical contrast profile across one or more of said selected features;

determining the polishing condition of the surface of the wafer on the basis of the measured contrast profile; and repeating the steps of measuring the optical contrast profile and determining the polishing condition until a predetermined polishing condition is reached;

determining the intensity and the sharpness of the contrast profile; and comparing the determined intensity and sharpness to predetermined values, to decide whether said predetermined polishing condition is reached.

2. The method according to claim 1, wherein said step of providing comprises orienting the wafer to be polished; and loading the wafer on a polishing head.

3. The method according to claim 1, wherein said one or more features on the wafer have a sharp edge, and the optical contrast profile across the edge or edges of said features is repeatedly measured to determine the polishing condition of the surface of the wafer.

4. The method according to claim 1, wherein a plurality of features on the wafer having sharp edges are selected for monitoring, and wherein the optical contrast profile across some subset of said plurality of features is measured in each measuring step to determine the polishing condition of the surface of the wafer.

5. The method according to claim 4, wherein regularly repeating structures on the wafer are selected as said plurality of identical or similar features.

6. The method according to claim 1, wherein said step of measuring the optical contrast profile comprises illuminating an area of the wafer containing the features to be measured with a light source, and detecting light reflected from the wafer and obtaining a contrast profile over the illuminated area therefrom.

7. The method according to claim 1, wherein after each repetition of the steps of measuring and determining the polishing condition, a removal rate for the layer to be polished and the total layer removal for the polishing process is calculated.

8. A method for polishing wafers by a chemical mechanical polishing tool, the method comprising the steps of setting polishing parameters of a chemical mechanical polishing tool;

polishing at least one wafer and monitoring a polishing condition of a surface of the wafer by providing the wafer to the polishing tool, the wafer having at least one optically distinguishable feature below a transparent or translucent layer to be polished, selecting one or more of said features for monitoring, measuring an optical contrast profile across one or more of said selected features, determining the polishing condition of the surface of the wafer on the basis of the measured contrast profile; and repeating the steps of measuring the optical contrast profile and determining the polishing condition is reached, and adjusting the polishing parameters of said chemical mechanical polishing tool on the basis of the results of monitoring the polishing condition to improve process throughput and process uniformity.

9. An apparatus for monitoring a polishing condition of a surface of a wafer having at least one optically distinguishable feature below a transparent or translucent layer to be polished, the apparatus comprising:

means for providing a wafer to be polished;

means for selecting one or more of said features for monitoring;

means for measuring an optical contrast profile across one or more of said selected features;

means for determining the polishing condition of the surface on the basis of the measured contrast profile;

means for determining whether a predetermined polishing condition is reached;

means for determining the intensity and the sharpness of the contrast profile; and means for comparing the determined intensity and sharpness to predetermined values, to decide whether said predetermined polishing condition is reached.

10. The apparatus according to claim 9, wherein said means for providing a wafer comprises means for orienting the wafer to be polished; and means for loading the wafer on a polishing head.

11. The apparatus according to claim 9, wherein said means for measuring the optical contrast profile comprises a light source for illuminating an area of the wafer containing the features to be measured, a sensor for detecting light reflected from the wafer, and means for obtaining a contrast profile over the illuminated area from the reflected light.

12. The apparatus according to claim 11, wherein the light source illuminates said area through a window in a polishing head.

13. The apparatus according to claim 9, further comprising means for calculating a removal rate for the layer to be polished and the total layer removal for the process based on the result of determining a polishing condition.

* * * * *

UNITED STATES PATENT AND TRADEMARK OFFICE

CERTIFICATE OF CORRECTION

PATENT NO. : 6,709,312 B2
APPLICATION NO. : 10/180740
DATED : March 23, 2004
INVENTOR(S) : Karl Emerson Mautz It is certified that error appears in the above-identified patent and that said Letters Patent is hereby corrected as shown below:

In Column 6, Line 14, Claim No. 5:

Change "of identical or similar features" to -- of features --.

In Column 6, Line 41, Claim No. 8:

Insert -- until a predetermined polishing condition -- between "condition" and "is reached".

Signed and Sealed this
Twelfth Day of April, 2011

David J. Kappos

David J. Kappos
*Director of the United States Patent and Trademark Office*